US011063372B2

(12) United States Patent
Garrec et al.

(10) Patent No.: US 11,063,372 B2
(45) Date of Patent: Jul. 13, 2021

(54) ELEMENTARY ANTENNA COMPRISING A PLANAR RADIATING DEVICE

(71) Applicants: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

(72) Inventors: Patrick Garrec, Pessac (FR); Anthony Ghiotto, Talence (FR); Gwenaël Morvan, Elancourt (FR)

(73) Assignees: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 0 days.

(21) Appl. No.: 16/478,411

(22) PCT Filed: Feb. 1, 2018

(86) PCT No.: PCT/EP2018/052529
§ 371 (c)(1),
(2) Date: Jul. 16, 2019

(87) PCT Pub. No.: WO2018/141852
PCT Pub. Date: Aug. 9, 2018

(65) Prior Publication Data

US 2019/0372240 A1 Dec. 5, 2019

(30) Foreign Application Priority Data

Feb. 1, 2017 (FR) ..... 1700101

(51) Int. Cl.
*H01Q 21/24* (2006.01)
*H01Q 9/04* (2006.01)
*H01Q 21/06* (2006.01)

(52) U.S. Cl.
CPC ..... *H01Q 21/245* (2013.01); *H01Q 9/045* (2013.01); *H01Q 9/0435* (2013.01); *H01Q 21/065* (2013.01)

(58) Field of Classification Search
CPC .... H01Q 21/065; H01Q 9/0435; H01Q 9/045; H01Q 1/2216; H01Q 1/2225; H01Q 1/24;
(Continued)

(56) References Cited

U.S. PATENT DOCUMENTS 6,466,171 B1 * 10/2002 Sherman ..... H01Q 9/0414 343/700 MS
7,705,782 B2 * 4/2010 Lee ..... H01Q 21/065 343/700 MS (Continued)

*Primary Examiner* — Renan Luque
(74) *Attorney, Agent, or Firm* — BakerHostetler

(57) ABSTRACT

An elementary antenna includes a planar radiating device comprising a substantially flat radiating element having a center and a plane defined by (i) a straight line passing through the center and (ii) another straight line perpendicular to the straight line and passing through the center, the radiating element comprising pairs of excitation points arranged in a quadruplet of excitation points located at a distance from the lines, comprising a first pair of excitation points arranged substantially symmetrically in relation to the straight line and a second pair of excitation points arranged substantially symmetrically in relation to the other line, the elementary antenna comprising processing to supply differential excitation signals for (i) exciting the excitation points and/or (ii) shaping signals emitted from the excitation points.

12 Claims, 4 Drawing Sheets

(58) Field of Classification Search
CPC .. H01Q 3/2623; H01Q 21/245; H01Q 9/0457; H01Q 9/0428; H04B 5/0062; H04B 1/525; H04B 7/10
See application file for complete search history.

(56) References Cited

U.S. PATENT DOCUMENTS

| | | | | |
|---|---|---|---|---|
| 10,454,175 | B2 * | 10/2019 | Petit | H01Q 23/00 |
| 2005/0206568 | A1 * | 9/2005 | Phillips | H01Q 9/0414 343/700 MS |
| 2006/0007044 | A1 | 1/2006 | Crouch et al. | |
| 2009/0128413 | A1 * | 5/2009 | Crouch | H01Q 3/26 343/700 MS |
| 2010/0156725 | A1 * | 6/2010 | Legay | H01Q 9/0464 343/700 MS |
| 2012/0188917 | A1 | 7/2012 | Knox | |
| 2014/0097990 | A1 * | 4/2014 | Aboush | H01Q 21/065 343/700 MS |
| 2014/0176369 | A1 | 6/2014 | Choi et al. | |
| 2014/0292595 | A1 * | 10/2014 | Kim | H01Q 21/28 343/720 |
| 2021/0028560 | A1 * | 1/2021 | Zenkyu | H01Q 21/245 |

* cited by examiner

| 1+ | 1- | 2- | 2+ | 3- | 3+ | 4+ | 4- | Polarization |
|---|---|---|---|---|---|---|---|---|
| 180° | 0° | 0° | 180° | 0° | 180° | 180° | 0° | Vertical |
| 180° | 0° | 180° | 0° | 0° | 180° | 0° | 180° | Horizontal |
| 180° | 0° | OFF | OFF | 0° | 180° | OFF | OFF | +45° |
| OFF | OFF | 0° | 180° | OFF | OFF | 180° | 0° | -45° |
| 180° | 0° | 90° | 270° | 0° | 80° | 270° | 90° | Right Circular (RCP) |
| 180° | 0° | 270° | 90° | 0° | 80° | 90° | 270° | Left Circular (LCP) |

| 1+ | 1- | 2+ | 2- | Polarization |
|---|---|---|---|---|
| 180° | 0° | 180° | 0° | Vertical |
| 180° | 0° | 0° | 180° | Horizontal |
| 180° | 0° | OFF | OFF | +45° |
| OFF | OFF | 180° | 0° | -45° |
| 180° | 0° | 270° | 90° | Right Circular (RCP) |
| 180° | 0° | 90° | 270° | Left Circular (LCP) |

ELEMENTARY ANTENNA COMPRISING A PLANAR RADIATING DEVICE

CROSS-REFERENCE TO RELATED APPLICATIONS

This application is a National Stage of International patent application PCT/EP2018/052529, filed on Feb. 1, 2018, which claims priority to foreign French patent application No. FR 1700101, filed on Feb. 1, 2017, the disclosures of which are incorporated by reference in their entirety.

FIELD OF THE INVENTION

The present invention relates to the field of array antennas and in particular active antennas. It is in particular applicable to radars, to electronic-warfare systems (such as radar detectors and radar jammers) and to communication systems or other multifunction systems.

BACKGROUND

A so-called array antenna comprises a plurality of antennas that may be of planar type, i.e. of the printed-circuit-board type, such antennas often being called patch antennas. Planar-antenna technology allows directional antennas of small thickness to be produced by producing the radiating elements by etching metal patterns on a dielectric layer equipped with a metal ground plane on its back side. This technology leads to very compact electronically scannable directional antennas that are simpler to produce and therefore less expensive than the Vivaldi antennas.

An active antenna conventionally comprises a set of elementary antennas each comprising one substantially planar radiating element coupled to a transmit/receive module (or T/R circuit). Transmission-side, the transmit/receive module adapts the phase and amplifies an excitation signal received from centralized signal-generating electronics and applies this excitation signal to the radiating element. Reception-side, the transmit/receive module amplifies a low-level reception signal received by the radiating element, while adapting the phase, and transmits this signal to a concentrating circuit that transmits it to a centralized acquisition circuit.

In radar applications in particular, there is a need to work with high powers.

However, the accessible powers are limited by the properties of the technologies implemented to produce the radiating elements. In particular, the monolithic-microwave-integrated-circuit (MMIC) technologies conventionally employed are characterized by limited maximum powers beyond which it would be desirable to be able to work for the aforementioned applications.

SUMMARY OF THE INVENTION

One aim of the invention is to mitigate this problem.

To this end, one subject of the invention is an elementary antenna comprising a planar radiating device comprising a substantially planar radiating element having a center, the plane containing the radiating element being defined by a first straight line passing through the center and a second straight line perpendicular to the first straight line and passing through the center, said radiating element comprising a plurality of pairs of excitation points arranged in at least one first quadruplet of excitation points located at a distance from the first straight line and from the second straight line, comprising a first pair composed of excitation points placed substantially symmetrically about said first straight line and a second pair composed of excitation points placed substantially symmetrically about said second straight line, the elementary antenna comprising a plurality of processing circuits able to deliver differential excitation signals intended to excite the excitation points and/or able to form signals issued from the excitation points, each pair of excitation points being coupled to a processing circuit so that the processing circuit is able to excite the pair of excitation points differentially and/or to process differential signals issued from the pair of points.

According to particular embodiments, the elementary antenna according to the invention comprises one or more of the following features, alone or in any technically possible combination:

- the elementary antenna comprises transmission-side phase-shifting means allowing introduction of a first transmission-side phase shift between a first excitation signal applied to the first pair of the excitation points and a second excitation signal applied to the second pair of excitation points and/or reception-side phase-shifting means allowing introduction of a first reception-side phase shift between a first reception signal issued from the first pair of the excitation points and a second reception signal issued from the second pair of excitation points,
- the excitation points of the first quadruplet of excitation points are placed so that the impedance of the radiating device measured between the points of each pair of excitation points of the first quadruplet of points is the same,
- the excitation points of the first pair of points are located on the same side of a third straight line of the plane containing the radiating element, the third straight line passing through the center and being a bisector of the first straight line and of the second straight line,
- the radiating element has a substantially rectangular shape, the first straight line and the second straight line being parallel to the sides of the rectangle,
- the radiating element comprises a second quadruplet of excitation points located at a distance from the first straight line and from the second straight line comprising:
  - third pair composed of excitation points placed substantially symmetrically about said first straight line, the points of the third pair of points being placed on the other side of the second straight line with respect to the first pair of excitation points,
  - fourth pair composed of excitation points placed substantially symmetrically about said second straight line, the points of the fourth pair of points being placed on the other side of the first straight line with respect to the second pair of excitation points.
- the excitation points of the second quadruplet of excitation points are placed so that the impedance of the radiating device, measured between the points of each pair of excitation points of the second quadruplet of points, is the same,
- the third pair is symmetric to the first pair about the second straight line and wherein the fourth pair is symmetric to the second pair about the first straight line,
- the elementary antenna comprises transmission-side phase-shifting means allowing introduction of a first transmission-side phase shift between a first excitation signal applied to the first pair of the excitation points and a second excitation signal applied to the second pair of excitation points and of a second transmission-side phase shift, able to be different from the first transmission-side phase shift, between a third excitation signal applied to the third pair of the excitation points and a fourth excitation signal applied to the fourth pair of excitation points and/or reception-side phase-shifting means allowing introduction of a first reception-side phase shift between a first reception signal issued from the first pair of the excitation points and a second reception signal issued from the second pair of excitation points and of a second reception-side phase shift, able to be different from the first reception-side phase shift, between a third reception signal applied to the third pair of the excitation points and a fourth reception signal applied to the fourth pair of excitation points, each pair of excitation points is coupled to one transmission channel configured to excite the pair of excitation points differentially, the transmission channels coupled to the first quadruplet of points being able to excite the first quadruplet of points by means of signals of a frequency different from a frequency at which the transmission channels coupled to the second quadruplet of points are able to excite the second quadruplet of points.

The invention also relates to an antenna comprising a plurality of elementary antennas according to the invention, wherein the radiating elements form an array of radiating elements.

Advantageously, the antenna comprises transmission-side pointing phase-shifting means allowing introduction of first transmission-side global phase shifts between the excitation signals applied to the first quadruplets of points of the respective elementary antennas and of second transmission-side global phase shifts between the excitation signals applied to the second quadruplets of points of the respective elementary antennas, the first and the second transmission-side global phase shifts being able to be different, and/or comprising reception-side pointing phase-shifting means allowing introduction of first reception-side global phase shifts between the excitation signals applied to the first quadruplets of points of the respective elementary antennas and of second reception-side global phase shifts between the excitation signals applied to the second quadruplets of points of the respective elementary antennas, the first and second reception-side global phase shifts being able to be different.

BRIEF DESCRIPTION OF THE DRAWINGS

Other features and advantages of the invention will become apparent on reading the following detailed description, which is given by way of nonlimiting example and with reference to the appended drawings, in which.

In all the figures, the same elements have been referenced by the same references.

DETAILED DESCRIPTION

Figure 1:
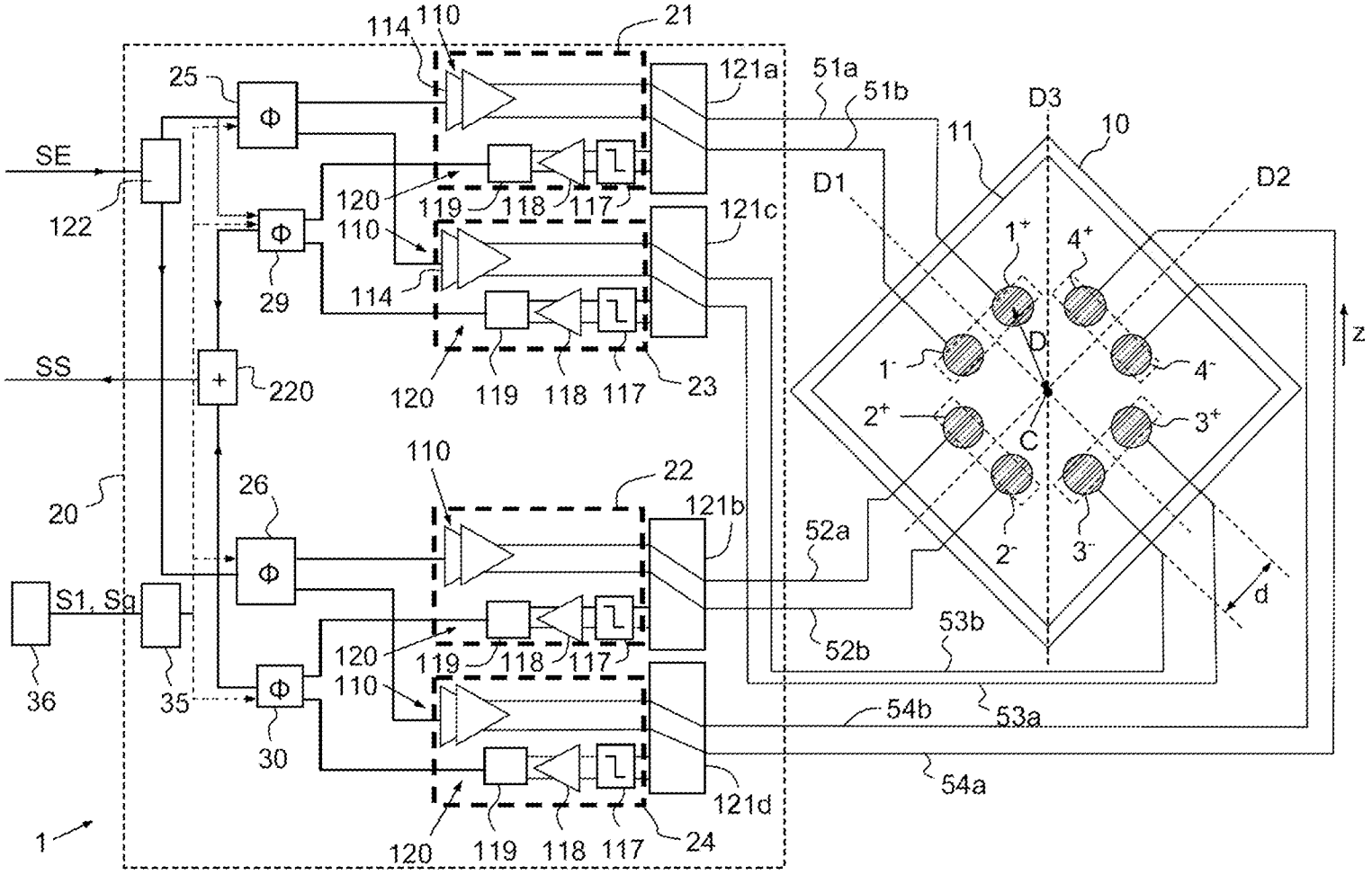
FIG. 1 schematically shows an elementary antenna according to a first embodiment of the invention.

In FIG. 1, an elementary antenna 1 according to a first embodiment of the invention has been shown.

The elementary antenna comprises a planar radiating device 10, shown in FIG. 1, comprising a substantially planar radiating element 11 lying substantially in the plane of the paper and comprising a center C. The planar radiating device is a planar antenna of the type better known as a patch antenna.

The invention also relates to an antenna comprising a plurality of elementary antennas according to the invention. The antenna may be an array antenna. The radiating elements 11 or the planar radiating devices 10 of the elementary antennas form an array of radiating elements. The antenna is advantageously an active antenna.

Figures 2, 3, 6:
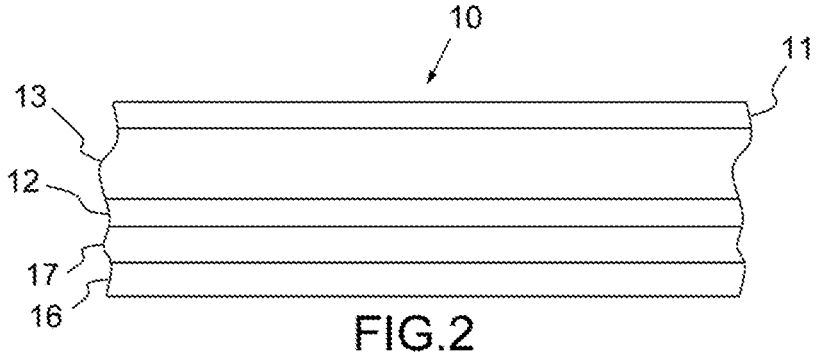
FIG. 2 shows a side view of an elementary antenna.
FIG. 3 shows a table collating various polarizations able to be obtained by means of the system of FIG. 1, FIG. 4 schematically shows an elementary antenna according to a second embodiment of the invention, FIG. 5 schematically shows an elementary antenna according to a third embodiment of the invention, FIG. 6 schematically shows the polarizations able to be obtained by means of the system of FIG. 5.

The planar radiating device 10 forms a stack such as shown in FIG. 2. It comprises a substantially planar radiating element 11, placed above a layer forming the ground plane 12, an interval is left between the radiating element 11 and the ground plane 12. This interval for example comprises an electrically insulating layer 13 for example made of a dielectric material. Preferably, the radiating element 11 is a sheet made of conductive material. As a variant, the radiating element 11 comprises a plurality of stacked metal sheets. It conventionally has a square shape. As a variant, the radiating element has another shape, for example a disk shape or the shape of another form of parallelogram such as for example a rectangle or a rhombus. Whatever the geometry of the radiating element 11, it is possible to define a center C.

The antenna comprises feed lines 51*a*, 51*b*, 52*a*, 52*b*, 53*a*, 53*b*, 54*a* and 54*b* that are coupled to the radiating element 11 at excitation points 1+, 1−, 2+, 2−, 3+, 3−, 4+, and 4− comprised in the radiating element 11. This coupling allows the radiating element 11 to be excited.

The coupling is for example achieved via slot-based electromagnetic coupling. The planar radiating device 10 then comprises a feed plane 16 (shown in FIG. 2) that serves as a vehicle for the ends of the feed lines 51*a*, 51*b*, 52*a*, 52*b*, 53*a*, 53*b*, 54*a* and 54*b*. The plane 16 is being advantageously separated from the ground plane 12 by a layer of insulating material 17, for example a dielectric. The planar radiating device 10 also comprises a plurality of slots. Each slot is produced in the layer forming the ground plane. One end of each line 51*a*, 51*b*, 52*a*, 52*b*, 53*a*, 53*b*, 54*a* and 54*b* is placed so as to overlap with a corresponding slot from below, the radiating element 11 being located above the layer forming the ground plane 12. The excitation point 1+, 1−, 2+, 2−, 3+, 3−, 4+, or 4− is then located plumb with the slot and the corresponding end. In FIG. 1, the projections of the slots are shown by dashed lines and each has a rectangular shape. These projections are not shown in the other figures for the sake of clarity. Each slot is provided for one pair of excitation points. As a variant, the device comprises one slot per excitation point. The slots are not necessarily rectangular, other shapes may be envisioned.

As a variant, the coupling is achieved by electrically connecting the end of the line to an excitation point of the radiating element. For example, at the end of the feed line, the excitation current flows into the radiating element, through the insulating material, for example by means of a metallized via allowing the end of the line to be connected to a pin located on the back of the radiating element plumb with the point to be excited. The coupling may be achieved in the same plane as the planar radiating element, or patch, by attacking it directly with a printed microstrip line or microstrip, connected to the edge of the radiating element. The excitation point is then located at the end of the feed line. The excitation may also be achieved by proximity coupling using a printed microstrip line located between the patch and the layer forming the ground plane.

The coupling may be achieved in the same way or differently for the various excitation points.

According to the invention, to optimize the power, the excitation points are duplicated. In the example of FIG. 1, the radiating element 11 thus comprises four pairs of excitation points 1+, 1−; 2+, 2−; 3+ et 3− and 4+, 4−.

The plane of the radiating element 11 is defined by two orthogonal directions. These two directions are the first straight line D1 and the second straight line D2. Each of these orthogonal directions passes through the center C.

According to the invention, the radiating element 11 comprises a first quadruplet of excitation points that are all located at a distance from the straight lines D1 and D2, i.e. that all located away from the straight lines D1 and D2, said first quadruplet of points comprising:

- a first pair of excitation points 1+, 1−, which pair is composed of an excitation point 1+ and an excitation point 1−, which points are arranged substantially symmetrically about the first straight line D1,
- a second pair of excitation points 2+, 2−, which pair is composed of an excitation point 2+ and an excitation point 2−, which points are arranged substantially symmetrically to each other about the first straight line D2.

The radiating element 11 comprises a second quadruplet of excitation points that are all located at a distance from the straight lines D1 and D2, the second quadruplet of points comprising:

- a third pair of excitation points 3+, 3−, which pair is composed of an excitation point 3+ and an excitation point 3−, which points are arranged substantially symmetrically about the first straight line D1, the excitation points 3+ and 3− of the third pair of points being placed on the other side of the second straight line D2 with respect to the first pair of excitation points 1+, 1−,
- a fourth pair of excitation points 4+, 4− comprising an excitation point 4+ and an excitation point 4−, which points are arranged substantially symmetrically about the first straight line D2, the excitation points 4+ and 4− of the fourth pair of points being placed on the other side of the first straight line D1 with respect to the second pair of excitation points 2+, 2−.

In other words, the points of each pair occupy positions that are substantially symmetric to each other about either D1 or D2. In other words, the points of each pair are substantially symmetric to each other in reflectional symmetry of axis D1 or D2.

The excitation points of each of the two quadruplets of points are distinct. In other words, the two quadruplets of points have no excitation points in common. The various pairs have no excitation points in common.

The excitation points of each pair of excitation points are placed so as to be able to be excited differentially, i.e. by means of two opposite signals. To this end, the points of a given pair of excitation points are placed so as to have identical impedances measured with respect to the ground.

Thus, in the nonlimiting examples of the figures, the straight lines D1 and D2 being parallel to the respective sides of the square formed by the plane of the radiating element 11, the distances separating the points of each pair are identical.

The elementary antenna 1 also comprises a transmit/receive module 20 as illustrated in FIG. 1 in particular. The transmit/receive module 20 of FIG. 1 comprises four electronic transmit/receive circuits 21 to 24.

The circuits 21 to 24 are placed between, on the one hand, microwave-signal-generating circuits and/or processing and acquisition circuits, which circuits are centralized, and on the other hand the feed lines.

Each pair of excitation points 1+, 1−; 2+, 2−; 3+, 3− and 4+, 4− is coupled to its excitation circuit 21, 22, 23 or 24, respectively, by means of a transmission line comprising two feed lines 51*a*, 51*b*, 52*a*, 52*b*, 53*a*, 53*b* or 54*a*, 54*b*, respectively, each having one end coupled to one of the excitation points 1+ or 1−; 2+ or 2−; 3+ or 3− and 4+ or 4− from which the pair is composed. Each transmission line allows a differential signal to be conveyed from/to the associated circuit.

Each circuit 21, 22, 23 or 24 is coupled to a pair of excitation points so as to be able to apply a differential excitation signal to one of the pairs of excitation points and to acquire differential reception signals issued from the pair of excitation points via the line. Advantageously, each circuit is configured to apply a differential excitation signal to the respective pairs of excitation points.

In the nonlimiting examples of figures, the four transmit/receive circuits 21 to 24 are identical.

The transmit/receive circuits 21 to 24 are advantageously produced in MMIC technology. Preferably, an SiGe (silicon-germanium) technology is used, but a GaAs (gallium arsenide) or GaN (gallium nitride) technology could equally well be used. Advantageously, but nonlimitingly, as illustrated in FIG. 1, the transmit/receive circuits of a given elementary antenna are produced on the same substrate so as to form a single circuit 20. This variant has a small bulk, facilitating the integration of the circuit 20 behind the planar radiating device 10.

Each transmit/receive circuit 21, 22, 23 and 24, respectively, comprises, in the example of FIG. 1, one transmission channel 110 coupled to one pair of excitation points and being intended to deliver excitation signals intended to excite the pair of excitation points, and one reception channel 120 able to form the reception signal issued from the pair of excitation points. Each of these chains is coupled to a pair of points by means of one of the pairs of feed lines 51*a*, 51*b*; 52*a*, 52*b*; 53*a*, 53*b* and 54*a*, 54*b*, respectively, via a switch 121*a*, 121*b*, 121*c*, and 121*d*, respectively. The feed lines are formed by conductors, i.e. tracks.

The tracks are for example frequency-tuned tracks.

Each circuit may be a transmit circuit and/or a receive circuit. It may comprise one transmission channel and/or one reception channel.

Each channel is designed to have an optimal performance when it is loaded (when the output of a transmission channel is loaded or when the input of a reception channel is loaded) by a well-defined optimal impedance; it has a degraded performance when it is loaded with an impedance different from its optimal value. Advantageously, the points are positioned and coupled to the radiating device so that, for each circuit 21 to 24, the transmission channel 110 and/or the reception channel 120 is loaded with its optimal impedance.

The optimal input or output impedance of a channel is substantially the optimal input impedance of the input amplifier of this channel or the optimal output impedance of the output amplifier of this channel, respectively.

Advantageously, the impedance with which a circuit 21, 22, 23 or 24 is loaded is the impedance of the chain formed by each feed line connecting the radiating device to the circuit 21, 22, 23 or 24 and by the radiating device between these lines. Therefore, the proposed solution allows the consumption, in transmit mode, to be optimized and/or the noise factor, in receive mode, to be improved. Thus, it is possible to avoid having to make, with respect to impedance matching, a compromise that could prove to be costly in terms of performance, or to avoid having to provide at least one of the channels with an impedance converter.

Advantageously, but not necessarily, the points are positioned and coupled to the radiating device so that the impedance of the radiating device 10 called the differential impedance, i.e. the impedance measured between two points of a pair of excitation points, is substantially the conjugate of an impedance of the transmit/receive circuit 21, 22, 23 or 24 on the side of the radiating device, i.e. substantially the conjugate of an output impedance of a transmission channel and/or of an input impedance of a reception channel of a transmit/receive circuit 21, 22, 23 or 24 coupled to the pair of points. The transmission and reception channels will be described below.

The output impedance of a transmission channel is substantially an output impedance of an output amplifier of the channel. The output impedance of a reception channel is substantially an input impedance of an input amplifier of the channel.

The ability to thus adjust the impedance avoids the need to use a component to match, by impedance conversion, the impedances of the transmit/receive circuits 21 to 24 and the radiating device 10. This saving in components helps improve the power efficiency of the transmitting and/or receiving device, all of the power output from a transmission and/or reception channel being applied to the radiating means. Moreover, matching the impedance of the radiating device to that of the excitation circuit allows currents to be limited and maximum powers to be generated. As a variant, an impedance-converting device is provided between the radiating device 10 and the transmit/receive circuit 20 in order to match the impedance of the radiating device between the two points of the pair of points to the output impedance of the transmission channel and/or to the output impedance of the reception channel. The ability to adjust the impedance of the points allows, just the same, impedance matching to be facilitated.

Advantageously, the excitation points of the respective pairs 1+ and 1− or 2+ and 2− or 3+ and 3− or 4+ and 4− are placed so that the impedance that the radiating device 10 presents to a transmit/receive circuit 21 to 24 between the excitation points of the pair of excitation points that is coupled to the transmit/receive circuit is the same for all the pairs of excitation points.

This impedance is, for example, nonlimitingly, 50 ohms. This impedance may be different from 50 ohms, it may depend on the technology and on the class of the amplifiers employed in the transmit/receive circuits.

The points of the two quadruplets of points have the same impedance. To this end, in the example of the figures, the first and third pair of each set are symmetric to each other about the straight line D2, and the second and fourth pair of each set are symmetric to each other about the straight line D1. Thus, the excitation points of each pair of points are advantageously located substantially at the same distance D from the center C, and the points of the pairs of points are all separated by the same distance. As a variant, the impedances of the radiating device between the pairs of respective points are not all identical. For example, in one variant, the points are placed so that the impedances formed by the radiating device between the pairs of points 1+; 1− and 2+, 2− are identical and so that the impedances formed by the radiating device between the pairs of excitation points 3+, 3− and 4+, 4− are the same but different from those formed between the points 1+; 1− and 2+, 2−. To this end, the points 1+, 1−; 2+, 2− are for example at the same distance from the center, different from another distance separating the points 3+, 3− and 4+, 4− from the center C.

In the embodiment of FIG. 1, transmission-side, an excitation signal SE applied by the electronics for generating a microwave signal to the input of the circuit 20 is divided into four elementary excitation signals, which are applied to the input of the transmission channels 110 of the respective transmit/receive circuits 21 to 24. Apart from the relative phases and optionally the altitudes thereof, the four elementary excitation signals are identical. The module 20 comprises a distributor 122 allowing the common excitation signal SE to be split into two excitation signals, which may be asymmetric or symmetric (i.e. differential or balanced), which signals are respectively injected into the input of respective transmission phase-shifters 25, 26. Each phase-shifter 25, 26 delivers an asymmetric or differential signal. The signal output from the first transmission phase-shifter 25 is injected into the input of the transmission channel 110 of the first circuit 21 and into the input of the transmission channel 110 of the third circuit 23. The signal output from the second transmission phase-shifter 26 is injected into the input of the transmission channel 110 of the second circuit 22 and into the input of the transmission channel 110 of the fourth circuit 24.

The transmission channels comprise at least one amplifier 114 allowing the excitation signal SE to be amplified. In radar and electronic-warfare applications, the transmission channels for example comprise a high-power amplifier 114.

Each transmission channel 110 delivers a differential signal. These signals are applied to the pairs of respective lines 51*a* and 51*b*, 52*a* and 52*b*, 53*a* and 53*b*, 54*a* and 54*b* in order to excite the pairs of respective excitation points. This allows a differential excitation of the pairs of respective excitation points to be achieved. The points of a given pair are then excited by means of opposite signals.

The respective transmission channels 110 are advantageously coupled to the respective excitation points so that the elementary waves excited by the first circuit 21 and the third circuit 23 are polarized in the same direction and so that the elementary waves excited by the second circuit 22 and the fourth circuit 24 are polarized in the same direction. In other words, the electric fields of the excitation signals applied to the first and to the third pair of excitation points 1+, 1−, 3+, 3− have the same direction. Thus, these two pairs of points allow the same signal to be delivered as from two asymmetrically excited points. The power needing to be delivered by the amplifier 114 is thus divided by two and the current needed to be delivered by this amplifier is then divided by the square root of two. Ohmic losses are therefore lower and it is easier to produce two amplifiers 114 of lower power than a single amplifier delivering all the power. Likewise, the electric fields of the excitation signals applied to the second and to the fourth pair of excitation points 2+, 2−, 4+, 4− advantageously have the same direction.

The transmit/receive module 20 comprises transmission-side phase-shifting means 25, 26 comprising at least one phase-shifter, allowing introduction of a first phase shift, called the first transmission-side phase shift, between the signal applied to the first pair 1+, 1− and the signal applied to the second pair 2+, 2−, and introduction of the same first transmission-side phase shift between the signal applied to the pair 3+, 3− and the signal applied to the pair 4+, 4−. The elementary excitation signals injected as input into the transmission channel 110 of the first circuit 21 and of the circuit 23 are in phase. The elementary excitation signals injected as input into the transmission channel 110 of the second circuit 22 and of the fourth circuit 24 are in phase.

Advantageously, the first transmission-side phase shift is adjustable. The array antenna advantageously comprises an adjusting device 35 allowing the first transmission-side phase shift to be adjusted so as to introduce a preset first transmission-side phase shift.

Each pair of excitation points generates an elementary wave. With the first transmission-side phase shift, the elementary waves transmitted by the pairs 1+, 1− and 3+, 3− are phase shifted with respect to the elementary waves transmitted by the pairs 2+, 2− and 4+, 4−. By in-air recombination of the elementary waves, a total wave is obtained the polarization of which it is possible to make vary by varying the first transmission-side phase shift. Examples of relative phases between the transmission signals injected into the lines coupled to the respective coupling points are given in the table of FIG. 3, as are the obtained polarizations. The vertical polarization is the polarization along the z-axis shown in FIG. 1. Two points excited in phase opposition, separated by 180°, have opposite instantaneous excitation voltages. By way of example, the first row of the table of FIG. 3 illustrates the case where the lines coupled to the points 1+, 2+, 3+, 4+ are raised to the same voltage and the lines coupled to the points 1−, 2−, 3−, 4− are raised to the same voltage, which voltage is the opposite of the preceding one. The differential voltage is then symmetric about the straight line D3. The polarization is therefore oriented along this straight line, which is vertically oriented. The linear polarization at +45° is obtained by exciting only the pair 1+, 1− and the pair 3+, 3− with in-phase differential excitation signals without exciting the pairs 2+, 2− and 4+, 4−. This is for example achieved by adjusting the gain of the power amplifiers 114 of the circuits 22 and 24 so that they deliver a zero power. To this end, the amplifiers have a variable gain and means for adjusting the gain. In the example of the fifth row, the phase shifts between the points remain the same over time. Varying the phases over time produces a right circular polarization.

Reception-side, reception signals received by the pairs of respective excitation points 1+ and 1−, 2+ and 2−, 3+ and 3−, 4+ and 4− are respectively applied as input to the transmission channels 120 of the respective excitation circuits 21, 22, 23, 24. The reception channel 120 of each of the circuits comprises protecting means, such as a limiter 117, and at least one amplifier 118, such as a low-noise amplifier in electronic-warfare applications. The reception channel 120 also comprises a combiner 119 allowing elementary reception signals issued from the two lines 51*a* and 51*b* or 52*a* and 52*b* or 53*a* and 53*b* or 54*a* and 54*b* connected to the channel to be combined by applying a phase shift of 180° to one of the signals. As a variant, the reception channel transmits a differential signal to a phase-shifter.

The elementary reception signals output from the reception channel 120 of the first circuit 21 and from the reception channel 120 of the third circuit 23 are injected as input into a first reception phase-shifter 29 and the signals output from the reception channel 120 of the second circuit 22 and from the reception channel 120 of the fourth circuit 24 are injected as input into a second reception phase-shifter 30. These phase-shifters 29, 30 allow introduction of a first reception-side phase shift between the reception signals delivered by the reception channels 120 of the first and third circuits 21, 23 and those delivered by the reception channels of the second and fourth circuits 22, 24. These reception phase-shifters 29, 30 each comprise, nonlimitingly, a summer that sums the signals that are injected as input into the phase-shifter. The reception signals output from the reception phase-shifters 29, 30 are summed by means of a summer 220 of the module 20, before the resulting reception signal SS is transmitted to the remote acquisition electronics.

Thus, the transmit/receive module 20 comprises reception-side phase-shifting means 29, 30 allowing introduction of a first reception-side phase shift between reception signals issued from the pairs 1+, 1− and 2+, 2− and between the reception signals issued from the pairs 3+, 3− and 4+, 4−. In the nonlimiting embodiment of FIG. 1, these means are located at the output of the reception channels 120.

Advantageously, the first reception-side phase shift is adjustable. The device advantageously comprises an adjusting device allowing the reception-side phase shift to be adjusted, namely the device 35 in the nonlimiting embodiment of FIG. 1.

Advantageously, the first reception-side and transmission-side phase shifts are identical. This allows elementary waves having the same phases as the transmitted elementary waves to be received and thus measurements to be taken on a total reception wave having the same polarization as the total wave transmitted by the elementary antenna. As a variant, these phases may be different. They may advantageously be adjustable independently. This allows signals having different polarizations to be transmitted and received.

As a variant, the number of phase-shifters is different and/or the phase-shifters are placed elsewhere than at the input of the transmission channels or at the output of the transmission channels.

Advantageously, the antenna comprises what are called pointing phase-shifting means allowing introduction of adjustable global phase shifts between the excitation signals applied to the points of the respective elementary antennas of the antenna and/or between the reception signals issued from the points of the respective elementary antennas of the antenna.

In the nonlimiting example of FIG. 1, these means comprise a control device 36 that generates a control signal intended for the adjusting means 35 and the phase-shifters. The control device 36 generates a control signal comprising a first signal S1 that commands the introduction of the first transmission-side and reception-side phase shift (which is the same in the case of FIG. 1) and a global signal Sg that commands the introduction of the global phase shift to be applied to the signals received as input by each phase-shifter. The global phase shift may command the same global phase shift to be introduced into the respective elementary excitation signals, and into the respective elementary reception signals coming from the radiating element. This global phase shift allows, via recombination of the total waves transmitted by the elementary antennas of the array, the pointing direction of the wave transmitted by the antenna and of the wave measured by the antenna to be chosen. As a variant, the control device 36 receives different control signals in order to command the introduction of transmission-side and reception-side phase shifts (first phase shifts and global phase shifts). It is thus possible to independently control the polarizations and the pointing directions of the transmitted and measured waves. Electronic scanning of an array antenna is based on the phase shifts applied to the constituent elementary antennas of the array, the scan being determined by a phase relationship.

The elementary antenna advantageously comprises switching means allowing the signals output from the circuits 21 to 24 to be directed toward the device 10 and a reception signal to be input into the reception channel of each of the circuits.

In the nonlimiting embodiment of FIG. 1, these switching means comprise a switch 121*a*, 121*b*, 121*c*, 121*d* that is controlled so as to switch said circuit 21, 22, 23 and 24 either to the transmit operating mode, by connecting the transmission channel 110 of the circuits 21, 22, 23, 24 to the lines 51*a*, 51*b*; 52*a*, 52*b*; 53*a*, 53*b*; 54*a*, 54*b*, or to a receiver operating mode, by connecting the reception channel 120 of the circuits to the lines 51*a*, 51*b*; 52*a*, 52*b*; 53*a*, 53*b*; 54*a*, 54*b*, respectively.

As a variant, each excitation circuit comprises an electronic circulator connected to the corresponding pair of excitation points and to the transmission channel and to the reception channel of the circuit. The transmission-side and reception-side circuits then operate simultaneously.

The device according to the invention has many advantages.

Each circuit 21 to 24 is able, transmission-side, to apply a differential signal and, reception-side, to acquire a differential signal, i.e. a balanced signal. Since the circuit already works with differential signals, there is no need to interpose a component, such as a balun (for balanced unbalanced transformer) to pass from a differential signal to an asymmetric signal. Now, such an intermediate component degrades power efficiency. The power efficiency of the device is therefore improved.

To work at high powers, the invention uses transmit/receive circuits that are coupled to four pairwise quadrature-polarized ports, each circuit operating at a nominal power compatible with the maximum acceptable power of the technology used to manufacture it.

The power of the electromagnetic waves transmitted or received by the radiating means may therefore be higher than the nominal operating power of the circuit coupled to this pair of excitation points. Each pair of differentially excited excitation points of the radiating element generates one elementary wave. The antenna works in a two-fold differential mode, on transmission and on reception. The power of the elementary wave transmitted by the pair of excitation points is two times higher than the nominal transmission-side power of the transmit circuit.

This is particularly advantageous when the nominal power is close to the maximum power permitted by the technology employed to produce the excitation circuits. Although in each excitation circuit the power remains below the maximum power, the elementary antenna allows waves to be transmitted at a higher power.

The choice of the technology of the radiating device sets the voltage to be applied to the excitation points. The higher the voltage the lower the current at equal power and impedance and the lower the ohmic losses. For an identical impedance, dividing the output power by two divides the current by the square root of two. Since the proposed solution sums the power directly in the patch or radiating element 11, ohmic losses are greatly decreased.

As specified above, the energy is summed directly in the excitation points. It is therefore not necessary, to transmit four times more power, to provide circuits having amplifiers that are four times more powerful. It is also not necessary to sum, outside of the radiating means, signals output from amplifiers of limited power, for example by means of ring or Wilkinson summers. The invention allows the number of lines used and the ohmic losses in the conductors to be limited, and therefore the power generated to compensate for these losses to be limited. It is also not necessary, to limit the losses, to sum energy in the MMICs. If the summations are performed in the MMICs, it is necessary for the losses to be dissipated in this critical location. Heating of the antenna and ohmic losses are thus decreased.

Moreover, the in-space recombination of the four elementary waves transmitted by the radiating element leads to a total wave the power of which is four times higher than the power of each elementary wave.

Reception-side, the incident total wave is decomposed into four elementary waves that are transmitted to the respective excitation circuits. An elementary wave possesses a power four times lower than the incident total wave. This makes it possible to increase antenna robustness with respect to exterior aggressions, such as irradiation of the antenna by a device performing intentional or unintentional jamming. The risk of deterioration of the low-noise amplifier is limited. For example, the aggressiveness of strong fields will be less because the elementary signals are not received in the optimal polarization but at 45° (when the transmissions are either of horizontal or vertical but not oblique polarization). The antenna of FIG. 1 allows cross-polarization measures to be implemented, a transmission in the horizontal polarization and a reception in vertical polarization for example by not applying the same first transmission-side and reception-side phase shifts.

Moreover, if the excitation points of each pair are excited differentially, i.e. balancedly, each pair of points transmits a linearly polarized elementary wave. By applying a phase shift between the excitation signal of the first pair of points 1+, 1− and of the third pair of points 3−, 3+ and the excitation signals of the second pair of points 2+, 2− and the fourth pair of points 4+, 4−, i.e. the points orthogonal to the first and third pair of points, the radiating element 11 is alone able to generate a polarized wave by in-space recombination of the four elementary waves.

This allows the need to use polarization-selecting switches placed between the transmit/receive circuit and the radiating element to choose a direction in which the radiating element must be excited to be avoided. This also allows the transmit/receive circuit to be directly connected to the excitation points and thus power yield to be increased, i.e. losses to be limited. Heating of the elementary antenna is thus decreased.

Figure 4:
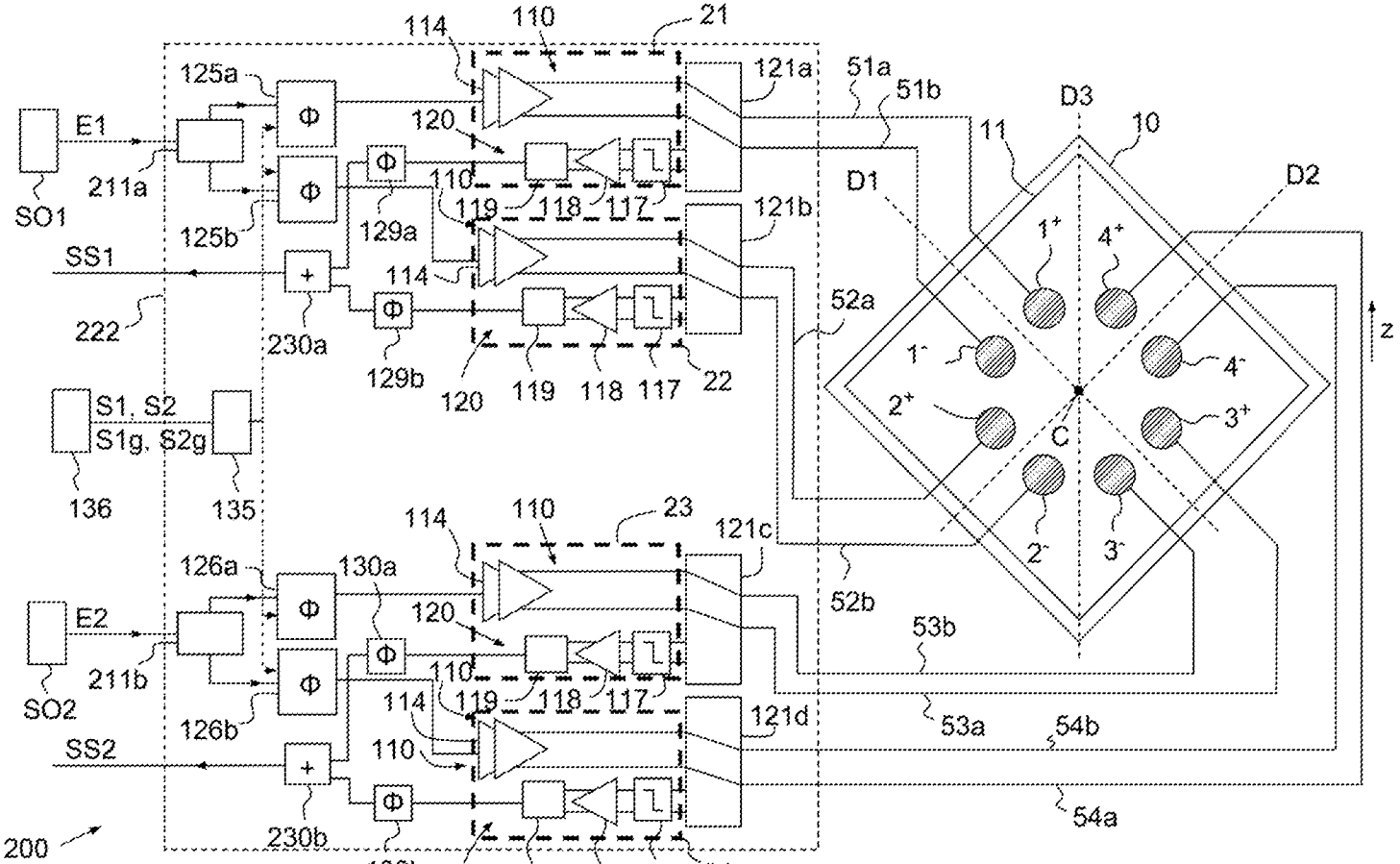

In FIG. 4, a second example of an elementary antenna 200 according to the invention has been shown.

The planar radiating device 10 is identical to that of FIG. 1. The antenna comprises the same transmit/receive circuits 21 to 24 coupled in the same way as in FIG. 1 to the respective pairs of excitation points 1+, 1−; 2+, 2−; 3+, 3− and 4+, 4−.

In contrast, the transmit/receive module 222 differs from that of FIG. 1. It comprises transmission-side phase-shifting means comprising at least one phase-shifter allowing introduction of a first transmission-side phase shift θ1 between the excitation signals applied to the pairs of excitation points 1+, 1− and 2+, 2− and of a second transmission-side phase shift θ2 between the excitation signals applied to the pairs of points 3+, 3− and 4+, 4−, these two transmission-side phase shifts being able to be different. This allows waves having different polarizations to be transmitted by means of the two quadruplets of points.

In the nonlimiting example shown in FIG. 4, these transmission-side phase-shifting means comprise a first transmission phase-shifter 125*a* and a second transmission phase-shifter 125*b* that receive signals that, apart optionally from the amplitude thereof, are identical, and that each introduce a phase shift into the received signal so as to introduce the first transmission-side phase shift between the excitation signals applied to the pair 1+, 1− and to the pair 2+, 2−. The phase-shifting means comprise a third transmission phase-shifter 126*a* and a fourth transmission phase-shifter 126*b* that receive signals that, apart optionally from the amplitude thereof, are identical, and that each apply a phase shift to the signal so as to introduce the second transmission-side phase shift between the excitation signals applied to the pair 3+, 3− and to the pair 4+, 4−. The first and second transmission-side phase shifts may be different. The excitation signals issued from the phase-shifters 125*a* and 125*b* are injected as input into the circuits 21 and 22, respectively. The excitation signals issued from the phase-shifters 126*a* and 126*b* are injected as input into the circuits 23 and 24, respectively. It is thus possible to simultaneously transmit two beams having different polarizations by means of two quadruplets of points.

The transmit/receive module 222 comprises reception-side phase-shifting means 129*a*, 129*b*, 130*a*, 130*b* allowing introduction of a first reception-side phase shift between the excitation signals applied to the pairs of excitation points 1+, 1− and 2+, 2− and of a second reception-side phase shift Θ2 between the excitation signals applied to the pairs of points 3+, 3− and 4+, 4−, these two phase shifts being able to be different. The reception signals output from the reception channels of the respective circuits 21 to 24 are injected into the respective reception phase-shifters 129*a*, 129*b*, 130*a*, 130*b* allowing each to introduce a phase shift into the signal that it receives. Each reception signal is injected into one of the phase-shifters.

Advantageously, the phase shifts introduced between the excitation or reception signals of the pairs of points 1+, 1− and 2+, 2− and between the pairs 3+, 3− and 4+, 4− are identical. As a variant, these phase shifts may be different. This allows two waves the polarizations of which may be different to be transmitted and received.

Advantageously, the phase shifts are adjustable.

Advantageously, the phase shifts introduced between the transmission or reception signals issued pairs of points 1+, 1− and 2+, 2− and between the pairs 3+, 3− and 4+, 4− may advantageously be adjusted independently. It is then possible to independently adjust the polarizations of the elementary waves transmitted or measured by the first quadruplet of points 1+, 1−, 2+, 2− and by the second quadruplet of points 3+, 3−, 4+, 4−.

The antenna array advantageously comprises an adjusting device 135 allowing the transmission-side and reception-side phase shifts to be adjusted.

Advantageously, the antenna comprises what are called pointing phase-shifting means allowing introduction of first transmission-side global phase shifts between the excitation signals applied to the first quadruplets of points 1+, 1−, 2+, 2− of the respective elementary antennas and of second transmission-side global phase shifts between the excitation signals applied to the second quadruplets of points 3+, 3−, 4+, 4− of the respective elementary antennas of the array, the first and second transmission-side global phase shifts being able to be different and/or of first reception-side global phase shifts between the reception signals issued from the first quadruplets of points 1+, 1−, 2+, 2− of the respective elementary antennas and of second reception-side global phase shifts between the reception signals issued from the second quadruplets of points 3+, 3−, 4+, 4− of the respective elementary antennas of the array, the first and second reception-side global phase shifts being able to be different. It is then possible to simultaneously transmit two beams in two different directions.

Advantageously, the transmission-side and/or reception-side global phase shifts are adjustable.

Advantageously, the transmission-side and/or reception-side global phase shifts are independently adjustable. The pointing directions are independently adjustable.

The device of FIG. 4 is able to measure a beam in one direction and to simultaneously transmit a beam in another direction or to simultaneously take two measurements in two directions, the control device then receiving different global signals in order to command the introduction of the transmission-side and reception-side phase shifts. It is possible to transmit and receive a signal in one direction and to transmit a transmission and receive the communication in another direction. It is therefore possible to perform crossed transmissions/receptions. It is possible to form, reception-side or transmission-side, a radiation pattern covering side and spurious lobes in order to allow side-lobe-suppression (SLS) functions that allow the radar to be protected from intentional or unintentional jamming signals. It is possible to transmit at various frequencies, this complexifying the task of radar detectors (electronic support measures or ESM).

In the nonlimiting example of FIG. 4, these means comprise a control device 136 allowing a control signal intended for the adjusting device and the phase-shifters to be generated. The signal generator 136 generates a control signal comprising a first signal S1 that commands the introduction of the first transmission-side and reception-side phase shift (when they are identical) and a first global signal S1*g* that commands the introduction of a first global phase shift to be applied to the signals received as input by each phase-shifter coupled to a pair of the first quadruplet of points 1+, 1−, 2+, 2−. The control device 136 also generates a second signal S2 that commands the introduction of the second transmission-side and reception-side phase shift (when they are identical) and a second global signal S2*g* that commands the introduction of a global phase shift to be applied to the signals received as input by each phase-shifter coupled to a pair of the second quadruplet of points 3+, 3−, 4+, 4−. As a variant, the control device 136 receives different control signals to command the introduction of the transmission-side and reception-side phase shifts. It is thus possible to independently control the polarizations and pointing directions of the waves transmitted and measured by each of the quadruplets of points.

In the embodiment in FIG. 4, the transmission channels of the two quadruplets of points 1+, 1−, 2+, 2− and 3+, 3', 4+, 4− are fed by means of two different feed sources SO1, SO2. This allows two waves having different frequencies to be transmitted, one by means of the first quadruplet of points 1+, 1−, 2+, 2− and the other by means of the second quadruplet of points 3+, 3−, 4+, 4−, when the sources deliver excitation signals E1 and E2 of different frequencies.

This allows two waves having different frequencies to be transmitted, one by means of the first quadruplet of points 1a+, 1a−, 2a+, 2a− and the other by means of the second quadruplet of points 3a+, 3a−, 4a+, 4a−, when the sources deliver excitation signals E1 and E2 of different frequencies. The antenna of FIG. 4 may thus simultaneously transmit two beams directed in two independently adjustable pointing directions at different frequencies. This ability to point two beams in two directions simultaneously allows an equivalent to a dual beam to be obtained: a rapidly scanned beam and a beam scanned more slowly. For example a slow beam at 10 revolutions per minute may be used in surveillance mode and a fast beam, at one revolution per second, may be used in pursuit mode. These scanning modes are not interleaved as in single-beam antennas, but may be implemented simultaneously. The ability to transmit at different frequencies complexifies the task of radar detectors (electronic support measures or ESM). This also allows a data link to be established in one direction and a radar function to be performed in another direction. This embodiment also allows two beams of different shapes to be transmitted. It is possible to transmit a narrow beam or a wide beam depending on the number of elementary antennas of the array that are excited.

The transmit/receive module 20 comprises a first distributor 211*a* allowing the excitation signal E1 issued from the first source SO1 to be split into two identical signals that are injected as input into the two respective first transmission phase-shifters 125*a*, 125*b*. The circuit 120 comprises a second distributor 211*b* allowing the excitation signal E2 issued from the second source to be split into two identical signals that are injected as input into the two other respective transmission phase-shifters 126*a*, 126*b*.

The reception signals output from the reception phase-shifters are summed pairwise by means of respective summers 230*a*, 230*b* of the module 20. The signals issued from the respective summers are transmitted separately to the remote acquisition electronics. In the nonlimiting example of FIG. 4, the two signals issued from the first reception phase-shifter 129*a*, which receives as input a reception signal issued from the first pair of lines 51*a*, 51*b*, and from the second reception phase-shifter 129*b*, which receives as input a reception signal issued from the second pair of lines 52*a*, 52*b*, are summed by means of a first summer 230*a*, in order to generate a first output signal SS1. The two signals issued from the third reception phase-shifter 130*a*, which receives as input a reception signal issued from the third pair of lines 53*a*, 53*b*, and from the fourth reception phase-shifter 130*b*, which receives as input a reception signal issued from the fourth pair of lines 54*a*, 54*b*, are summed by means of a second summer 230*b*, in order to generate a second output signal SS2. The signals output by the respective summers are transmitted separately to the remote acquisition electronics. This allows reception signals having different frequencies to be differentiated. The signals issued from the two quadruplets of points being summed separately, it is possible to form a reception-side antenna covering side and spurious lobes in order to allow side-lobe-suppression (SLS) functions allowing the radar to be protected from intentional or unintentional jamming signals.

As a variant, the transmission and/or reception channels associated with the two quadruplets of points may be different, i.e. have different powers and/or passbands of different widths. It is thus possible to provide transmission channels of high power and of narrow passband for one of the quadruplets of points, in order to transmit, for example, a radar signal, and transmission channels of lower power and of wide passband, in order to transmit, for example, jamming signals.

As a variant, the two excitation signals E1 and E2 have the same frequency. It is therefore possible to obtain a more powerful total wave as in the embodiment of FIG. 1. It is also possible to transmit two beams at the same frequency in two different directions and/or two beams having different polarizations.

Figure 5:
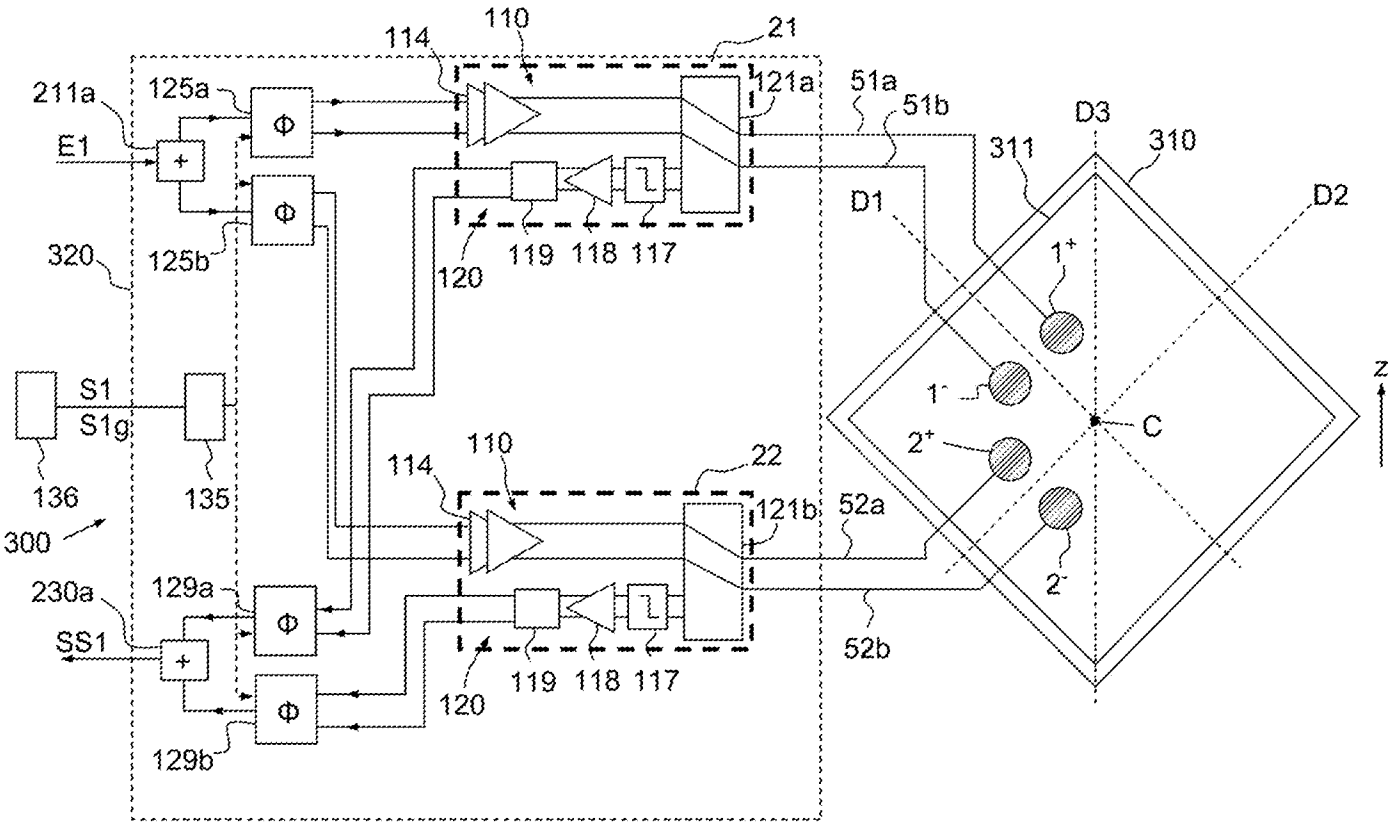

In FIG. 5, an elementary antenna 300 according to a third embodiment of the invention has been shown.

The elementary antenna differs from that of FIG. 4 in that its radiating element 311 comprises only the first quadruplet of points 1+, 1−, 2+, 2−. The associated transmit/receive device 320 differs from that of FIG. 4 in that it only comprises the portion of the transmit/receive device coupled to this quadruplet of points 1+, 1−, 2+, 2−. It only comprises the first circuit 21 and the second circuit 22.

The fact that the radiating element is excited with two excitation signals that are applied to pairs of excitation points that are located in quadrature with respect to each other allows the symmetry of the transmit/receive pattern of the elementary antenna to be increased.

This elementary antenna is able to transmit a wave the polarization of which is adjustable and to receive a wave having an adjustable polarization direction. Examples of phases of the signals injected into the lines coupled to the respective coupling points are given in the table of FIG. 6, as are the obtained polarizations. Consider by way of example the first row. The points 1+ and 2+ have the same excitation (same phases) and the points 1− and 2− have the same excitation, which excitation is opposite to that of the other points. The polarization is therefore vertical, i.e. along the z-axis shown in FIG. 5. Global phase-shifting means are also envisionable.

This elementary antenna also allows array antennas to be produced that allow a total wave the pointing direction of which is adjustable to be transmitted.

The power of the wave transmitted by the device of FIG. 5 is in contrast two times lower than that transmitted by means of the device of FIG. 1. The decrease in power reception-side is two times lower than that of the device of FIG. 1.

Advantageously, the excitation points of the elementary antenna of FIG. 5 are located on the same side of a third straight line D3 located in the plane defined by the radiating element 11, passing through the center C and being a bisector of the two straight lines D1 and D2. This allows half of the radiating element to be freed, in order to produce other types of excitation for example.

When the radiating element is substantially square, as in the figures, the straight line D3 joins the two apexes of the square.

Advantageously, the first quadruplet of points 1−, 1+, 2+ and 2− of the antennas of FIGS. 1 and 4 are also located on the same side of the straight line D3 and on the other side of the straight line D3 with respect to the second quadruplet of points 3+, 3−, 4+, 4−.

In the embodiments of FIGS. 1, 4 and 5, the transmit/receive circuits coupled to each pair of points are identical. As a variant, these circuits may be different.

The invention claimed is:

1. An elementary antenna, comprising:

a radiating element, having:

a center, a plane defined by (i) a first straight line passing through the center and (ii) a second straight line perpendicular to the first straight line and passing through the center, and a plurality of pairs of excitation points arranged in at least one first quadruplet of excitation points, each excitation point of the quadruplet of excitation points being distant from the first straight line and from the second straight line, the pairs comprising (i) a first pair of excitation points (1+, 1−) that are placed substantially symmetrically about said first straight line and (ii) a second pair composed of excitation points (2+, 2) that are placed substantially symmetrically about said second straight line; and a plurality of processing circuits configured to at least one of (i) deliver differential excitation signals intended to excite the excitation points and (ii) form signals issued from the excitation points, each pair of excitation points being coupled to a processing circuit so that the processing circuit is configured to at least one of excite the pair of excitation points differentially and process differential signals issued from the pair of points.

2. The elementary antenna as claimed in claim 1, further comprising at least one of:

transmission-side phase-shifters allowing introduction of a first transmission-side phase shift between a first excitation signal applied to the first pair of the excitation points (1+, 1−) and a second excitation signal applied to at least one of the second pair of excitation points (2+, 2−);

and reception-side phase-shifters allowing introduction of a first reception-side phase shift between a first reception signal issued from the first pair of the excitation points (1+, 1−) and a second reception signal issued from the second pair of excitation points (2+, 2−).

3. The elementary antenna as claimed in claim 1, wherein the excitation points of the first quadruplet of excitation points are placed so that the impedance measured between the points of each pair of excitation points of the first quadruplet of points is the same.

4. The elementary antenna as claimed in claim 1, wherein the excitation points of the first pair of excitation points are located on the same side of a third straight line of the plane containing the radiating element, the third straight line passing through the center and being a bisector of the first straight line and of the second straight line.

5. The elementary antenna as claimed in claim 1, wherein the radiating element has a substantially rectangular shape, the first straight line and the second straight line being parallel to the sides of the rectangular shape.

6. The elementary antenna as claimed in claim 1, wherein said radiating element further comprises a second quadruplet of excitation points located at a distance from the first straight line and from the second straight line, the second quadruplet comprising (i) a third pair of excitation points (3+, 3−) placed substantially symmetrically about said first straight line, the third pair of excitation points (3+, 3−) being placed on the other side of the second straight line with respect to the first pair of excitation points (1+, 1−), and (ii) a fourth pair of excitation points (4+, 4−) placed substantially symmetrically about said second straight line, the fourth pair of excitation points (4+, 4−) being placed on the other side of the first straight line with respect to the second pair of excitation points (2+, 2−).

7. The elementary antenna as claimed in claim 6, wherein the excitation points of the second quadruplet of excitation points are placed so that the impedance measured between the points of each pair of excitation points of the second quadruplet of points, is the same.

8. The elementary antenna as claimed in claim 6, wherein the third pair is symmetric to the first pair about the second straight line and wherein the fourth pair is symmetric to the second pair about the first straight line.

9. The elementary antenna as claimed in claim 6, further comprising at least one of:

transmission-side phase-shifters allowing introduction of a first transmission-side phase shift between a first excitation signal applied to the first pair of the excitation points (1+, 1−) and a second excitation signal applied to the second pair of excitation points (2+, 2−) and of a second transmission-side phase shift, different from the first transmission-side phase shift, between a third excitation signal applied to the third pair of the excitation points (3+, 3−) and a fourth excitation signal applied to the fourth pair of excitation points (4+, 4−); and reception-side phase-shifters allowing introduction of a first reception-side phase shift between a first reception signal issued from the first pair of the excitation points (1+, 1−) and a second reception signal issued from the second pair of excitation points (2+, 2−) and of a second reception-side phase shift, different from the first reception-side phase shift, between a third reception signal applied to the third pair of the excitation points (3+, 3−) and a fourth reception signal applied to the fourth pair of excitation points (4+, 4−).

10. The elementary antenna as claimed in claim 9, wherein each pair of excitation points is coupled to one transmission channel configured to excite the pair of excitation points differentially, the transmission channels coupled to the first quadruplet of points exciting the first quadruplet of points using signals of a frequency different from a frequency at which the transmission channels coupled to the second quadruplet of points are exciting the second quadruplet of points.

11. An antenna comprising a plurality of elementary antennas as claimed in claim 1, wherein the radiating elements form an array of radiating elements.

12. An antenna, comprising:

a plurality of elementary antennas as claimed in claim 6 and at least one of:

transmission-side pointing phase-shifters allowing introduction of (i) first transmission-side global phase shifts between the excitation signals applied to the first quadruplets of points of the respective elementary antennas and (ii) second transmission-side global phase shifts between the excitation signals applied to the second quadruplets of points of the respective elementary antennas, the first and the second transmission-side global phase shifts being different, and reception-side pointing phase-shifters allowing introduction of (i) first reception-side global phase shifts between the excitation signals applied to the first quadruplets of points of the respective elementary antennas and (ii) second reception-side global phase shifts between the excitation signals applied to the second quadruplets of points of the respective elementary antennas, the first and second reception-side global phase shifts being different.

* * * * *